United States Patent [19]

Thumberger et al.

[11] 4,240,170

[45] Dec. 23, 1980

[54] ADJUSTABLE FOOT BRACE

[76] Inventors: Ollibelle Thumberger; Harold C. Thumberger, both of 1031 Belle Ave., Hamilton, Ohio 45015

[21] Appl. No.: 950,566

[22] Filed: Oct. 12, 1978

[51] Int. Cl.[2] ..... A47C 21/00

[52] U.S. Cl. ..... 5/508; 5/445

[58] Field of Search ..... 248/285-287; 297/417

[56] References Cited

U.S. PATENT DOCUMENTS

| | | | |
|---|---|---|---|
| 2,749,196 | 6/1956 | Wolfe | 5/507 |
| 3,535,720 | 10/1970 | Woods | 5/507 |
| 3,893,197 | 7/1975 | Ricke | 5/444 |

*Primary Examiner*—Casmir A. Nunberg

*Attorney, Agent, or Firm*—Wood, Herron & Evans

[57] ABSTRACT

An adjustable foot brace connectable to a bed. The adjustable foot brace includes a foot panel movable between an upper position where the panel extends generally transverse to the bed's sides, and a lower position beneath the mattress' top surface and adjacent one of the mattress' sides. The foot panel, when in the transverse position, is automatically braked in the desired transverse position when the bed user's feet push against the foot panel, is automatically released from the braked transverse position when no foot force is applied against the panel, and is manually movable longitudinally of the bed to position the panel where desired, whether in the storage or use position, if no force is applied against the panel.

19 Claims, 6 Drawing Figures

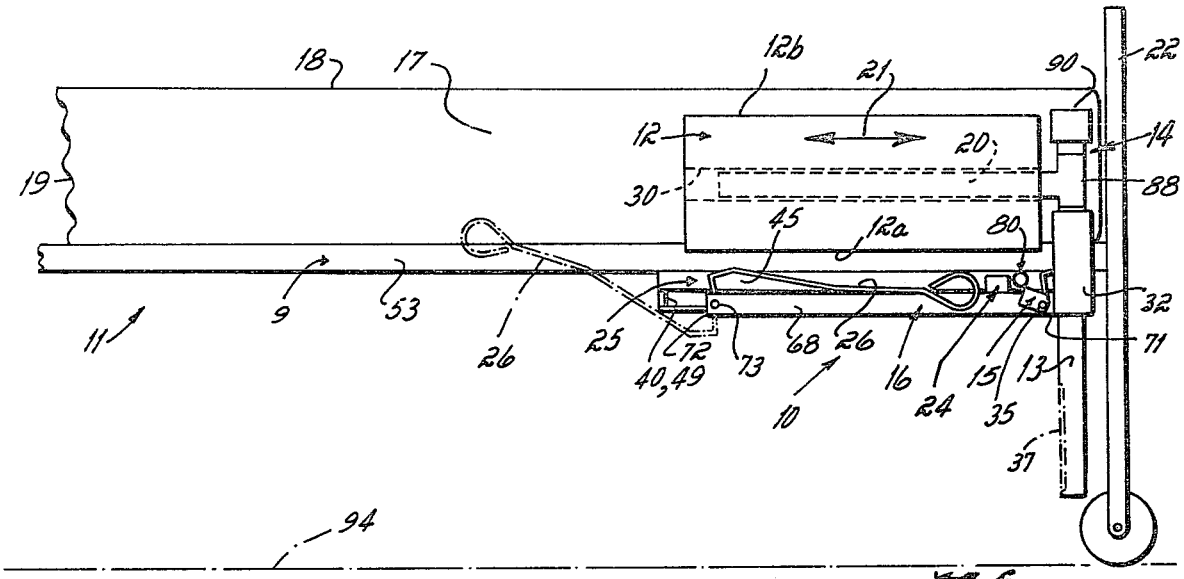
Fig. 1
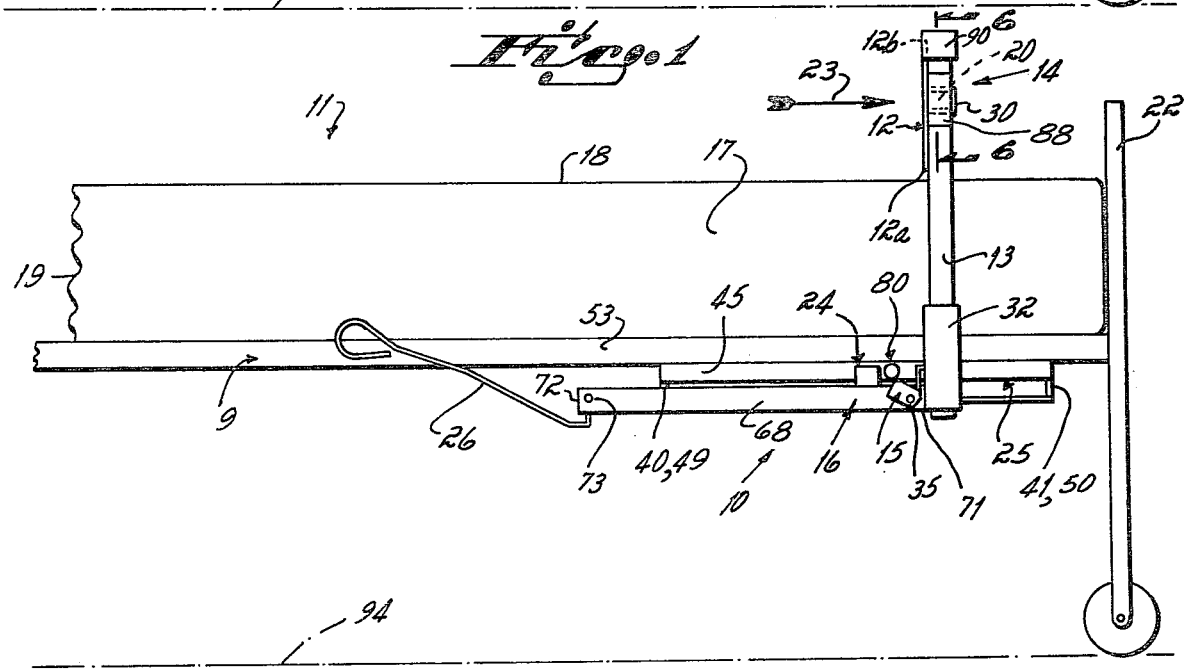
Fig. 2
Fig. 3
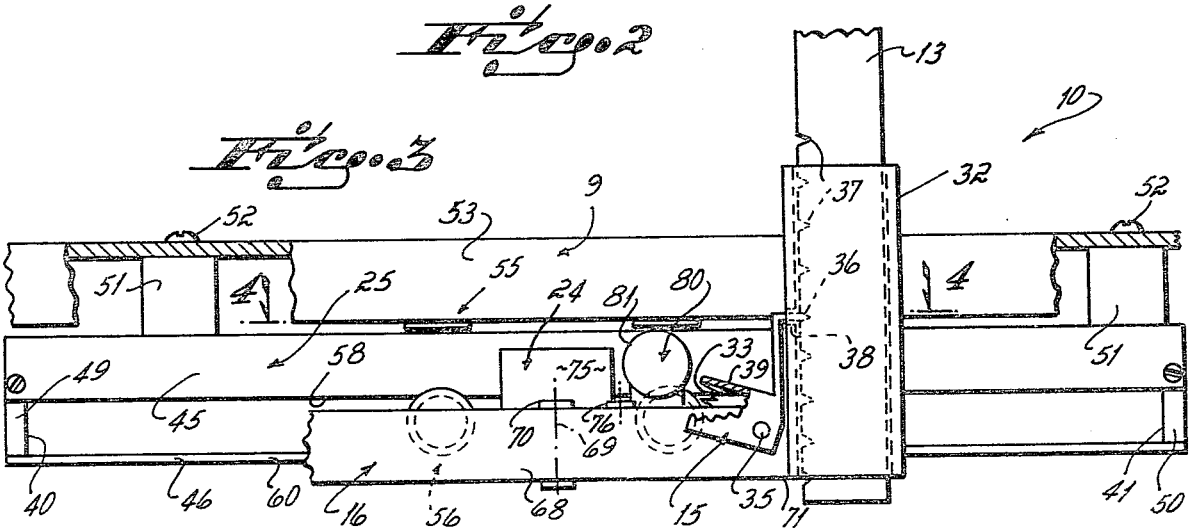

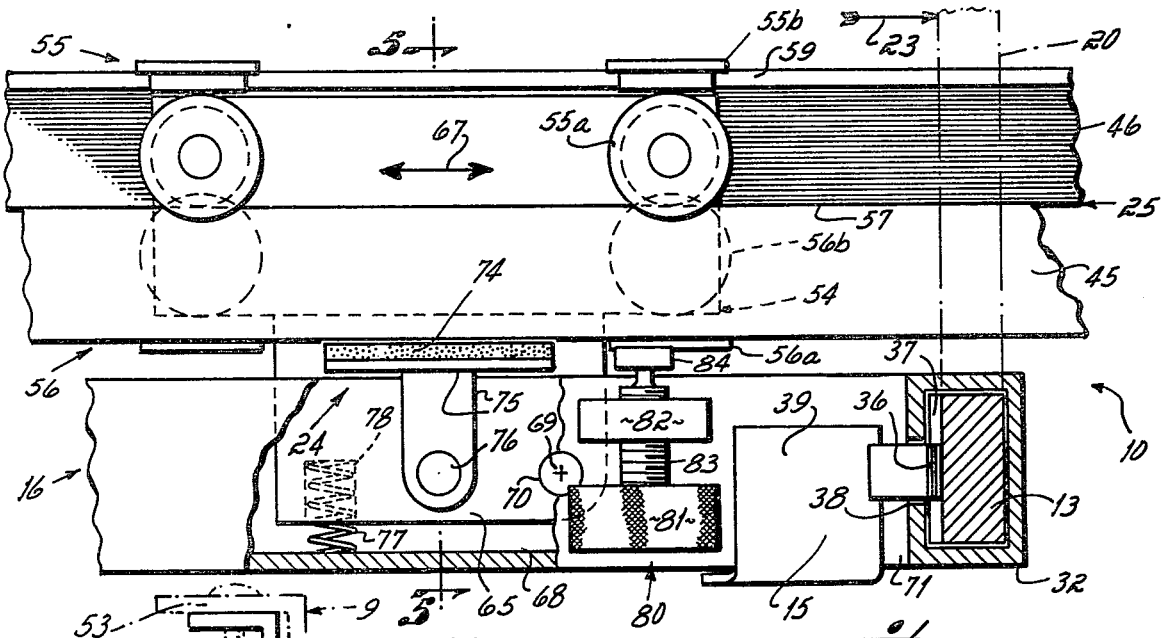
Fig. 4
Fig. 5
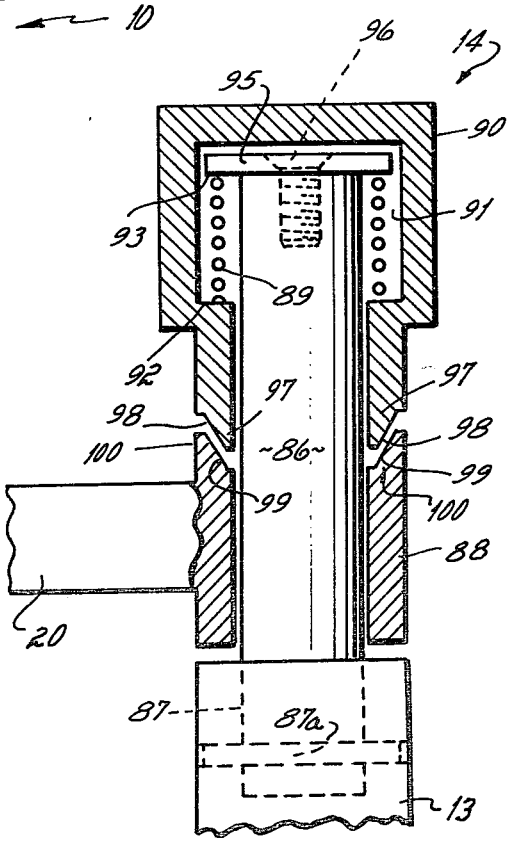
Fig. 6

ADJUSTABLE FOOT BRACE

This invention relates to beds and more particularly, this invention relates to an adjustable foot brace for a bed.

One of the common problems that a bed patient experiences is that of moving himself back toward the headboard end of the bed after he has slipped from a sitting or reclined position to an undesirable location toward the footboard end of the bed. This is particularly bothersome to a bed patient who spends extended periods of time in bed with his head and shoulders raised by having the headboard end of the bed's mattress partially elevated. Normally, after slipping downwardly in the bed, the bed patient simply uses his hands and feet as best he can in an effort to push himself back toward the bed's headboard end. However, this may prove especially difficult for an elderly patient, or for a patient partially indisposed above the waist, because of the physical exertion required.

Therefore, it has been the primary objective of this invention to provide an improved foot brace for use in aiding a bed's user to push himself back up toward the bed's headboard end from the footboard end, the brace being adjustably connectable to a bed for moving the brace's foot panel between a storage position and a use position as desired by the user.

It has been another objective of this invention to provide an adjustable foot brace for a bed, the brace's foot panel being movable between a storage position located adjacent one of the bed's sides beneath the mattress' top surface and a use position generally transverse to the bed's sides above the mattress' top surface, the foot brace being adjustable manually relative to the longitudinal axis of the bed when and as desired by the bed's user while reclining in the bed.

It has been a further objective of this invention to provide an adjustable foot brace for a bed, the brace's foot panel, when oriented in use position transverse to the bed's sides, being automatically braked in the desired use position when a foot force is exerted by the user on the foot panel toward the footboard end of the bed, and being automatically released from the braked position when that foot force is released by the user.

In accord with these objectives, the adjustable foot brace of this invention includes, in preferred form, a foot panel movable between an upper position where the panel extends generally transverse to the bed's sides, and a lower position beneath the mattress' top surface and adjacent one of the mattress' sides. The foot panel, when in the transverse position, is automatically braked in the desired transverse position when the bed user's feet push against the foot panel, is automatically released from the braked transverse position when no foot force is applied against the panel, and is manually movable longitudinally of the bed to position the panel where desired, whether in the storage or use position, if no force is applied against the panel. Other objectives and advantages of this invention will be more apparent from the following detailed description taken in conjunction with the drawings in which:

FIG. 1 is a side elevational view illustrating an adjustable foot brace in accord with the principles of this invention, the foot panel being located in the storage position;

FIG. 2 is a side elevational view similar to FIG. 1, but illustrating the adjustable foot panel in a use position;

FIG. 3 is an enlarged side elevational view illustrating certain major components of the foot brace structure;

FIG. 4 is a cross sectional view taken along line 4—4 of FIG. 3;

FIG. 5 is a cross sectional view taken along line 5—5 of FIG. 4; and FIG. 6 is a cross sectional view taken along line 6—6 of FIG. 2.

The adjustable foot brace 10 of this invention is shown in structural combination with a bed 11 in FIGS. 1 and 2. Basically, the adjustable foot brace 10 includes a foot panel 12 swingably mounted on a support post 13 by means of a swivel device 14, the support post 13 being mounted on a movable carriage 16 connected to bed frame 9. The support post 12 (and, hence, the foot panel 12) is adjustably located in a desired vertical position by a latch 15 on the horizontally reciprocable carriage 16. FIG. 1 illustrates the foot panel 12 in a storage position where it is positioned parallel to one of the bed's sides 17 and beneath the top surface 18 of the bed's mattress 19. FIG. 2 illustrates a use position of the adjustable foot brace 10 in which the foot panel 12 is located transverse to the bed's sides 17 and above the top surface 18 of the bed's mattress 19. The foot panel 10 may be positioned between the sides 17 of the bed 11 as desired, when in the FIG. 2 attitude, since the foot panel itself is slidable on support arm 20 in the direction shown by phantom arrow 21. The foot panel 12, when in the FIG. 2 position, is prevented from movement toward the footboard 22 of the bed 11 in response to a foot force (shown by phantom arrow 23) exerted thereon through use of a friction brake 24 automatically engageable with the foot brace's carriage tracks 25, as more particularly described in detail below. Further, the foot panel 10, when in the FIG. 2 position, is manually positionable longitudinally of the bed, i.e., between the bed's footboard 22 and the headboard (not shown), when no force 23 is exerted on the foot panel through use of manual handle 26 and the movable carriage 16, also as more particularly described in detail below.

The foot panel 12 itself includes, on the footboard face thereof, a square cross section sleeve 30 in which square cross section support arm 20 is slidably received, see FIG. 1. The support arm 20 extends transverse to a support post 13, and is connected thereto by the swivel device 14. The post 13, which does not rotate, cooperates with collar 32 fixed to the carriage 16, the collar being vertically oriented and being sized so that the support post and, hence, the foot panel 12, is vertically movable relative to ground, see FIGS. 3 and 4. A spring 33 loaded latch 15, see FIGS. 3–5, is pivotally connected to the carriage 16 on pivot axis 35, the latch including tip 36 that cooperates with notches 37 in the adjacent surface of the support post 13 through vertical slot 38 in that support post for locating the support post and, hence, the foot panel 12, in the desired vertical position relative to the top surface 18 of the mattress 19. The latch 15 also includes thumb plate 39 which permits the latch to be easily disengaged from its normally spring 33 biased latch contact with the foot panels's support post 13.

The foot panel 12 is mounted on the carriage 16 through the support post 13, the carriage being movable between end limits 40, 41 defined by the carriage tracks 45, 46. The carriage tracks 45, 46 are in the nature of an upper angle track 45 and a lower angle track 46 disposed diagonally one from the other so as to define a generally square cross sectioned hollow track open at the other two diagonally opposed corners 47, 48, see FIG. 5. The upper 45 and lower 46 angle tracks are connected one with another by end plates 49, 50 that define the carriage 16 travel limits 40, 41. The upper angle track 45 is connected by mounting brackets 51 and bolts 52 to side frame member 53 of the bed frame 9 itself, see FIG. 3.

The carriage 16 itself is comprised of a relatively short base frame 54 of square cross section and sized to slide axially within the elongated enclosure defined by the carriage tracks 45, 46. The carriage base frame 54 includes a pair of rollers 55, 56 mounted on each of diagonally opposite corners thereof. One of the rollers 55*a*, 56*a* at each corner is positioned to cooperate with one edge 57, 58, respectively, of the upper angle track 45, and the other of the rollers 55*b*, 56*b* at the same corner is positioned to cooperate with one edge 59, 60, respectively of the lower angle track 46, see particularly FIG. 5. It is by means of the base frame 54 and roller 55, 56 structure that the carriage 16 is movable over the carriage tracks 45, 46.

The carriage 16 also includes a motion or pivot arm 68 structure to which the foot panel 12 and support post 13 are connected. The pivot arm 68 is pivotally connected to mounting ear 65 fixed to the base frame 54 as at 66, the mounting ear 65 extending transversely out from the reciprocal travel path 67 of the base frame, see FIGS. 4 and 5. The mounting ear 65 is connected with the pivot arm 68 on pivot axis 69 through use of pivot pin 70. The pivot axis 69 is disposed intermediate the ends 71, 72 of the pivot arm 68, one end 71 of the pivot arm being connected with the post collar 32, and the other end 72 of the pivot arm being connected with manual handle 26. The manual handle 26 is pivotally connected to arm 68 as at 73, and is adapted to pivot from a storage position shown in solid lines in FIG. 1 to a use position shown in phantom lines in FIG. 1.

The pivot arm 68 also supports stop structure in the form of the friction brake 24. The friction brake 24 includes a brake shoe 74 fixed to an upstanding leg of a right angle bracket 75. The other leg of bracket 75 is pivotably mounted on arm 68 through a pivot pin 76. This pivotable mounting of the brake allows the shoe 74 to "float" thereby permitting complete surface contact of the brake shoe 74 with rail 45 when the pivot arm 68 is skewed by force 23. The pivot pin 76 mounting of brake shoe 74 on pivot arm 68 allows compression spring 77 (which is received in bore 78 of ear 65 and bears against arm 68) to normally bias the brake shoe 74 out of contact with the upper carriage track 45 in the absence of pressure on foot panel 12 in the direction of force arrow 23. This normally maintains the brake shoe 74 in a non-braking attitude. The brake shoe 74 is readily movable into braking contact with the upper carriage track 45 when the pivot arm 68 is slightly pivoted on axis 69 from a parallelism position to a slightly skewed position relative to the upper carriage track.

The pivot arm 68 also mounts a lock device 80 that includes a knob 81 threaded into and through a bracket 82 fixed to the pivot arm 68 at a location between the pivot arm's pivot axis 69 and the support post end 71 thereof as shown in FIG. 4. The end of threaded shaft 83 opposite to the knob 81 end carries a pressure foot 84 which, when the shaft is threaded in the bracket 82 toward the upper carriage track 45, causes the foot 84 to press against that upper carriage track, thereby pivoting the pivot arm 68 clockwise against the spring 77, as shown in FIG. 4, so as to engage the brake shoe 74 with the upper track. Use of the lock device's knob 81, therefore, allows the pivot arm 68 to be braked into an immobile position (not shown) relative to the carriage tracks 45, 46 so that the carriage 16 itself cannot move over the carriage tracks. But when the lock device 80 is in the position shown in FIG. 4, linear motion of the carriage 16 is permitted.

The swivel device 14 by which the foot panel 12 pivots or swings relative to the non-rotatable support post 13 is particularly illustrated in FIG. 6. As shown, the support post 13, at the top end thereof, includes a stub shaft 86 mounted in bore 87 defined in the top end of the post 13, the stub shaft 86 being pinned in place in that bore 87 by pin 87*a*. The foot panel's support arm 20 includes a sleeve 88 at the connection end thereof which is slidably received on the stub shaft 86, and is rotatable relative thereto. A spring 89 loaded cap 90 is received over the top of the stub shaft 86, the cap defining an internal chamber 91 and internal ledge 92. The compression spring 89 is positioned in that chamber 91 between lower ledge 92 and an upper internal ledge 93 fixed to the stub shaft 86, thereby continuously biasing the cap downward relative to ground 94. The upper internal ledge 93 is defined by a plate 95 fixed to the stub shaft 86 by screw 96. The bottom edge 97 of the cap 90 is provided with a detent 98, and the top edge 100 of the support arm's sleeve 88 is provided with a notch or seat 99 defined on the interior edge thereof, the detent 98 and seat 99 being sized to permit 90° rotation of the foot panel 12 from the FIG. 1 attitude to the FIG. 2 attitude, i.e., from parallel to the bed side to normal to the bed side. This normally defines the operable pivot limits of the foot panel 12 since post 13 is not rotatable or pivotable in collar 32. However, and if greater than 90° rotation of the foot panel 12 is desired, it is possible to simply lift the cap 90 up against the normal bias of the compression spring 89 until the cap's detent 98 is disengaged from the sleeve's seat 99, thereby permitting the foot panel 12 to swing 360° relative to the support post 13.

In use, and in the storage position illustrated in FIG. 1, foot brace's carriage 16 is moved down toward the bed's footboard 22 until carriage frame 54 abuts the carriage track's end plate 50, see FIG. 1. In this storage location, the foot panel 12 is oriented parallel to one side of the bed 11, and is positioned on the support arm 20 adjacent the support post 13. Also in this storage position, the support post 13 is lowered until the foot panel's support arm 20 abuts the carriage's collar 32.

When use of the foot brace 10 is desired, the manual handle 26 may be pivoted from the storage position shown in solid lines in FIG. 1 to the use position shown in phantom lines in FIG. 1 and in solid lines in FIG. 2. The foot panel's support post 13 is upraised until the lower edge 12*a* of the foot panel 12 is disposed above the top surface 18 of the mattress 19, the post (and panel) being restrained in that upper position through use of the spring 33 loaded latch 15 as shown in FIG. 3. When upraised, the foot panel 12 is thereafter pivoted into the use location shown in FIG. 2 at which the foot panel is disposed normal or transverse to the bed's sides 17, the support arm 20 (and, hence, the panel) being located and stopped in that position by use of the notch seat 99 in the support arm's sleeve 88 in combination with the detent 98 on the support post's cap 90, as shown in FIG. 6. In this use position, the foot panel 12 can be positioned as desired between the bed's sides 17 merely by sliding the foot panel along support arm 20.

After the foot panel 12 is located in the transverse use position, the foot panel may be located in the desired longitudinal position desired between the bed's headboard (not shown) and the bed's footboard 22 simply by grasping the handle 26 and pulling or pushing the foot brace's carriage 16 to the desired location. The foot panel 12 is, of course, longitudinally movable between headboard and footboard 22 because it is connected by pivot arm 68 and mounting ear 65 to the roller frame 54 between the carriage tracks 45, 46.

Once in the desired use position, and in response to a user's foot force exerted in direction 23 against the foot panel 12, the user automatically brakes the foot panel 12 at the desired longitudinal position because of nominal pivoting of the pivot arm 68 about pivot axis 69 which, in turn, causes operative engagement of the brake shoe 74 with the immobile carriage track 45. The brake shoe 74, therefore, automatically locks or brakes the carriage 16 in the desired use position when a foot force in the direction of phantom arrow 23 is exerted against the foot panel, thereby allowing the user to push himself back up toward the bed's headboard simply in response to leg generated force 23 only. This is particularly useful to a bed patient when the headboard end of the mattress 19 has been elevated into a back rest type position as is commonly the case in hospital type beds. With the foot panel 12 in this position it is also possible for the patient to exercise his legs by periodically pushing against the panel 12. If it is desired to lock the foot panel 12 in the peselected longitudinal position of the transversely oriented foot panel, the lock device 80 is used as earlier described. This is useful to a nurse or other attendant for a bed patient in that it permits the foot barce 10 to be locked in position on the tracks 45, 46 so that a patient cannot move it. When the foot panel 12 is in the locked position, and with the panel 12 abutted up against a patient's foot so that the feet are held upright, the invention is particularly useful in helping to prevent a condition known as foot drop which occurs in longer term bed patients since the patient's toes are prevented from dropping toward the mattress.

When relocation of the transversely located foot panel 12 is desired in a different longitudinal position between the headboard and footboard 22, the user's feet are first withdrawn from a pressure relation with the foot panel 12. When so withdrawn, and assuming the lock device 80 is not in an operative position, the carriage 16 is easily moved through use of handle 26 because force 23 is no longer present and the spring 77 reacts to remove brake pressure from the carriage's upper track 45. In other words, and with no pressure 23 against foot panel 12, the carriage 16 is movable within the carriage tracks 45, 46 because the spring 77 returns the arm 68 to its normal non-skewed position so that the brake shoe 74 on pivot arm 68 is not forcefully pressed against the upper carriage track 45. Hence, the fixed location of the carriage 16 relative to the carriage tracks 45, 46 (in other words, the fixed longitudinal position of the foot panel 12) is automatically released once the foot force 23 is released from the transversely disposed foot panel 12.

When it is desired to store the foot panel 12 once again beneath the top surface 18 of mattress 19, the panel is merely swung from the FIG. 2 attitude back into the FIG. 1 attitude through use of the swing device 14. The foot panel 12 is located at a position where it is parallel to the bed's side 17 because of the support arm's seat 99 and support post's detent 98 relationship as shown in FIG. 6 and earlier described. Once the foot panel 12 is swung back parallel to the bed's side 17, the support post 13 is lowered simply through release of latch 15, thereby permitting the panel 12 to be located once again with the top edge **12*b* thereof beneath the mattress' top surface 18 in the FIG. 1** storage position.

Although this invention has been described in fixed combination with a bed, it is also contemplated that the adjustable foot brace may be portable relative to the bed. In the portable embodiment, not shown, the foot brace is mounted on a mobile stand that will permit the foot brace to be moved between a storage position in the user's room and a use position adjacent the bed's footboard end.

Having described in detail the preferred embodiment of my invention, what I desire to claim and protect by Letters Patent is:

1. An adjustable foot brace adapted for use with a bed, said foot brace comprising a foot panel to be located generally adjacent the footboard end of said bed, connector structure means connecting said foot panel to said bed's frame, said connector structure means being operable to enable said foot panel to be moved between a storage position beneath the top surface of the bed's mattress and parallel to the bed's side and a use position generally transverse to the bed's side and above the surface of the bed's mattress, said connector structure means comprising a post on which said foot panel is mounted, said post being generally vertically movable for locating said foot panel in the storage and use positions, and latch means cooperable with said post for holding said post in the desired position.

2. An adjustable foot brace as set forth in claim 1, said connector structure means comprising a support arm on which said foot panel is mounted, said arm cooperating with said panel to permit positioning of said panel between the bed's sides as desired by the user when said panel is in the use position.

3. An adjustable foot brace as set forth in claim 1, said connector structure means comprising a post on which said foot panel is mounted, and a swing device cooperable with said foot panel and post, said swing device permitting said foot panel to be swung between said storage and use positions, and said swing device locating said panel in both said storage and said use positions.

4. An adjustable foot brace as set forth in claim 3, said swing device also allowing 360° rotation of said foot panel relative to said post.

5. An adjustable foot brace as set forth in claim 1, said brace also comprising a carriage on which said foot panel is mounted, carriage tracks adapted to be mounted to said bed, said carriage being movable along said carriage tracks for positioning said foot panel between the bed's headboard and footboard as desired by the bed's user, and stop structure connected with said carriage, said stop stucture being operable to locate said carriage in a generally immobile position on said carriage tracks when desired by the bed's user, thereby also locating said foot panel in the desired use position between the bed's headboard and footboard.

6. An adjustable foot brace as set forth in claim 5, said stop structure comprising a brake operable in response to foot pressure of the bed's user on said foot panel for locating said carriage in said generally immobile position, release of said brake being effected by release of said foot pressure on said foot panel.

7. An adjustable foot brace as set forth in claim 6, said carriage comprising a motion arm movable between braking and non-braking position relative to said bed's frame, and a brake shoe mounted on said motion arm, said brake shoe being movable into braking relation with a braking surface that is immobile relative to said bed's frame.

8. An adjustable foot brace as set forth in claim 5, said brace further comprising a handle connected to said carriage, said handle being manually operable by the bed's user for positioning the carriage in the position desired.

9. An adjustable foot brace as set forth in claim 5, said carriage comprising a base frame enclosed by carriage tracks to prevent disengagement of said carriage with said carriage tracks, said carriage tracks being adapted to be connected to said bed frame, and said carriage tracks defining the motion limits of said carriage.

10. An adjustable foot brace adapted for use with a bed, said foot brace comprising a foot panel to be located generally adjacent the footboard end of said bed, a carriage on which said foot panel is mounted, carriage tracks adapted to be mounted adjacent to said bed, said carriage being movable along said carriage tracks for positioning said foot panel between the bed's headboard and footboard as desired by the bed's user, and stop structure connected with said carriage, said stop structure being operable to lock said carriage in a generally immobile position on said carriage tracks in response to foot pressure of the bed's user against the foot panel.

11. An adjustable foot brace as set forth in claim 10, said stop structure comprising a brake operable in response to foot pressure of the bed's user on said foot panel for locating said carriage in said generally immobile position, release of said brake being effected by release of said foot pressure on said foot panel.

12. An adjustable foot brace as set forth in claim 11, said carriage comprising a motion arm movable between braking and non-braking position relative to said bed's frame, and a brake shoe mounted on said motion arm, said brake shoe being movable into braking relation with a braking surface that is immobile relative to said bed's frame.

13. An adjustable foot brace as set forth in claim 10, said brace further comprising a handle connected to said carriage, said handle being manually operable by the bed's user for positioning the carriage in the position desired.

14. An adjustable foot brace as set forth in claim 10, said carriage comprising a base frame enclosed by carriage tracks to prevent disengagement of said carriage with said carriage tracks, said carriage tracks being adapted to be connected to said bed frame, and said carriage tracks defining the motion limits of said carriage.

15. An adjustable foot brace as set forth in claim 10, said brace further comprising connector structure adapted to connect said foot panel with said carriage, said connector structure allowing said foot panel to be moved between a storage position generally beneath the surface of the bed's mattress and a use position above the surface of the bed's mattress, and said connector structure also allowing said foot panel to be swung between a storage position generally parallel to the bed's side and a use position generally transverse to the bed's side.

16. An adjustable foot brace as set forth in claim 15, said connector structure comprising a post on which said foot panel is mounted, said post being generally vertically movable for locating said foot panel in the storage and use positions, and a latch cooperable with said post for holding said post in the desired position.

17. An adjustable foot brace as set forth in claim 15, said connector structure comprising a support arm on which said foot panel is mounted, said arm cooperating with said panel to permit positioning of said panel between the bed's sides as desired by the user when said panel is in the use position.

18. An adjustable foot brace as set forth in claim 15, said connector structure comprising a post on which said foot panel is mounted, and a swing device cooperable with said foot panel and post, said swing device permitting said foot panel to be swung between said storage and use positions, and said swing device locating said panel in both said storage and said use positions.

19. An adjustable foot brace as set forth in claim 18, said swing device also allowing 360° rotation of said foot panel relative to said post.

* * * * *

UNITED STATES PATENT AND TRADEMARK OFFICE

Certificate

Patent No. 4,240,170 Patented December 23, 1980

Ollibelle Thumberger and Harold C. Thumberger

Application having been made by Ollibelle Thumberger and Harold C. Thumberger, the inventors named in the patent above identified, for the issuance of a certificate under the provisions of Title 35, Section 256, of the United States Code, deleting the name of Ollibelle Thumberger as a joint inventor, and a showing and proof of the facts satisfying the requirements of the said section having been submitted, it is this 18th day of May 1982, certified that the name of the said Ollibelle Thumberger is hereby deleted from the said patent as a joint inventor with the said Harold C. Thumberger.

Fred W. Sherling
*Associate Solicitor.*